US009581381B2

(12) United States Patent
Jung

(10) Patent No.: US 9,581,381 B2
(45) Date of Patent: Feb. 28, 2017

(54) REFRIGERATOR

(71) Applicant: LG ELECTRONICS INC., Seoul (KR)

(72) Inventor: Jaehun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/944,348

(22) Filed: Nov. 18, 2015

(65) Prior Publication Data

US 2016/0146530 A1 May 26, 2016

(30) Foreign Application Priority Data

Nov. 20, 2014 (KR) ..... 10-2014-0162783

(51) Int. Cl.
*A47B 96/04* (2006.01)
*F25D 23/02* (2006.01)
(Continued)

(52) U.S. Cl.
CPC ..... *F25D 23/028* (2013.01); *E05F 15/611* (2015.01); *E06B 3/34* (2013.01);
(Continued)

(58) Field of Classification Search
CPC ..... F25D 23/028; F25D 23/062; F25D 2323/021; F25D 2700/02; E05F 15/611;
(Continued)

(56) References Cited

U.S. PATENT DOCUMENTS 4,711,098 A * 12/1987 Kuwabara ..... F25D 11/022 312/321.5
4,843,833 A * 7/1989 Polkinghorne ..... F25D 17/065 62/126

(Continued)

FOREIGN PATENT DOCUMENTS

JP 04126987 A * 4/1992
JP 2010118281 A * 5/2010
KR 10-2014-0097787 8/2015

OTHER PUBLICATIONS

Notice of Allowance issued in Korean Application No. 10-2014-0162783 on May 2, 2016, 3 pages (with English translation).

*Primary Examiner* — Hanh V Tran
(74) *Attorney, Agent, or Firm* — Fish & Richardson P.C.

(57) ABSTRACT

A refrigerator is described. The refrigerator includes a cabinet that includes a storage compartment; an inner case that defines the storage compartment. The refrigerator further includes a first door that is pivotally mounted to the cabinet. The refrigerator further includes a second door that is pivotally mounted to the cabinet and that is provided with a pillar that is configured to rotate between a folded orientation and an unfolded orientation, the pillar being configured to contact the first door and thereby close a gap between the first door and the second door based on the pillar being oriented in the unfolded orientation and the first door and the second door being closed. The refrigerator further includes a drive assembly that is located at the inner case and that is (Continued)

configured to rotate the pillar. The refrigerator further includes a controller that is configured to drive the drive assembly.

20 Claims, 10 Drawing Sheets

(51) Int. Cl.
*E06B 3/34* (2006.01)
*E05F 15/611* (2015.01)

(52) U.S. Cl.
CPC ..... *E05Y 2201/46* (2013.01); *E05Y 2900/31* (2013.01); *F25D 2323/021* (2013.01); *F25D 2700/02* (2013.01)

(58) Field of Classification Search
CPC ..... E05F 15/70; E06B 3/34; E05Y 2201/46; E05Y 2900/31
See application file for complete search history.

(56) References Cited

U.S. PATENT DOCUMENTS

RE33,960 E * 6/1992 Neuman ..... F25D 29/008 200/61.62
5,887,446 A * 3/1999 Lee ..... F25D 27/00 200/61.62
7,008,032 B2 * 3/2006 Chekal ..... F25D 11/02 312/405
8,454,102 B2 * 6/2013 Kim ..... E05F 15/619 312/319.5
8,864,251 B2 * 10/2014 Kuehl ..... F25D 21/14 312/402
9,163,870 B2 * 10/2015 Jeon ..... F25D 23/00
9,234,695 B1 * 1/2016 Dubina ..... F25D 23/028
2007/0118831 A1 * 5/2007 Kondo ..... E05B 47/0009 717/121
2008/0083243 A1 * 4/2008 Lee ..... E05F 15/63 62/446
2008/0134698 A1 * 6/2008 Cho ..... F25D 23/028 62/127
2008/0209812 A1 * 9/2008 Lancry ..... F25D 21/04 49/316
2009/0273264 A1 * 11/2009 Butler ..... F25D 23/028 312/405
2010/0141107 A1 * 6/2010 Kim ..... F25D 23/028 312/405
2011/0083461 A1 * 4/2011 Kim ..... E05F 15/619 62/264
2013/0241385 A1 * 9/2013 Lee ..... F25D 23/028 312/404
2014/0268648 A1 * 9/2014 Gomes ..... F25D 27/005 362/94
2014/0327353 A1 * 11/2014 Seo ..... F25D 23/028 312/405

* cited by examiner (b)

REFRIGERATOR

CROSS REFERENCE TO RELATED APPLICATION

This application claims the benefit of Korean Patent Application No. 10-2014-0162783, filed on Nov. 20, 2014, which is hereby incorporated by reference as if fully set forth herein.

FIELD

The present disclosure relates to a refrigerator, and more particularly to a refrigerator having two side-by-side type doors to open one storage compartment.

BACKGROUND

Generally, a refrigerator is an appliance for storing food in a fresh state within a storage compartment (freezing compartment or refrigerating compartment) for a certain period of time by cooling the storage compartment through repeated operation of a refrigeration cycle.

Such a refrigerator includes a compressor for compressing refrigerant circulating through a refrigeration cycle into a high-temperature and high-pressure state. The refrigerant compressed in the compressor generates cold air while passing through a heat exchanger, and the generated cold air is supplied to a freezing compartment or a refrigerating compartment.

Generally, the refrigerator has an arrangement in which the freezing compartment is arranged at the upper side, and the refrigerating compartment is arranged at the lower side. In a side-by-side type refrigerator, the freezing and refrigerating compartments thereof are arranged to laterally neighbor to each other.

In a refrigerator of another type, a storage compartment provided at the upper or lower side of the refrigerator can be opened by two side-by-side type doors.

In the case in which one storage compartment can be opened by two side-by-side type doors, a pillar is provided at one of the two doors. The pillar, which is provided at only one of the two doors, comes into contact with the two doors through rotation thereof when the storage compartment is closed by the two doors and, as such, functions to enhance sealability of the storage compartment.

In a conventional refrigerator provided with such a pillar, typically, a structure including a protrusion and a guide groove is provided at an inner case of the refrigerator in order to guide rotation of the pillar.

SUMMARY

An innovative aspect of the subject matter described in this specification may be implemented in a refrigerator that includes a cabinet that includes a storage compartment; an inner case that defines the storage compartment; a first door that is pivotally mounted to the cabinet and that is configured to open or close a first side of the storage compartment; a second door that is pivotally mounted to the cabinet, that is configured to open or close a second side of the storage compartment, and that is provided with a pillar that is configured to rotate between a folded orientation and an unfolded orientation, the pillar being configured to contact the first door and thereby close a gap between the first door and the second door based on the pillar being oriented in the unfolded orientation and the first door and the second door being closed; a first door switch that is configured to sense at least one of opening or closing of the first door; a second door switch that is configured to sense at least one of opening or closing of the second door; a drive assembly that is located at the inner case and that is configured to rotate the pillar between the folded orientation and the unfolded orientation by magnetic force; and a controller that is configured to drive the drive assembly based on at least one of the first door switch or the second door switch sensing movement of at least one of the first door or the second door opening or closing.

These and other implementations can each optionally include one or more of the following features. The controller is configured to drive the drive assembly to rotate the pillar to the folded orientation based on the first door switch sensing that the first door is open and the second door switch sensing that the second door is closed. The controller is configured to drive the drive assembly to rotate the pillar to the unfolded orientation based on at least one of the first door switch sensing that first door is closed or the second door switch sensing that the second door is closed. The controller is configured to drive the drive assembly to rotate the pillar to the folded orientation based on at least one of the first door switch sensing that the first door is opening or the second door switch sensing that the second door is opening while the first door and the second door are closed. The drive assembly includes a drive magnetic member that is configured to move in a forward direction and a rearward direction relative to the cabinet. The pillar includes a first pillar magnetic member that is configured to magnetically interfere with the drive magnetic member. The pillar is configured to rotate toward the second door to the folded orientation based on the drive magnetic member moving toward a rear side of the cabinet.

The pillar is configured to rotate toward the second door to the unfolded orientation based on the drive magnetic member moving toward a front side of the cabinet. The drive assembly further includes a motor that is configured to generate a rotational force in a normal direction or a reverse direction; and a gear unit that is configured to move the drive magnetic member in the forward direction or the rearward direction by the rotational force of the motor. The drive magnetic member has a center that is positioned in front of a center of the first pillar magnetic member based on the drive magnetic member being moved toward a foremost side of the cabinet. The drive magnetic member is configured to rotate the pillar to the unfolded orientation by extending away from the drive assembly. The drive magnetic member is configured to rotate the pillar to the folded orientation by retracting towards the drive assembly. The gear unit includes a first gear that is configured to change a rotation direction of the motor; a second gear that is configured to engage the first gear and that is configured to rotate together with the first gear; and a rack gear that is configured to engage the second gear and that is configured to convert rotation of the second gear into a linear motion. The motor includes a rotation shaft that is substantially parallel to the forward direction and the rearward direction. The second door includes a door magnetic member.

The pillar includes a second pillar magnetic member that is configured to magnetically interfere with the door magnetic member. Based on the pillar being rotated toward the second door to the folded orientation, the pillar is configured to remain in the folded orientation by an attraction between the door magnetic member and the second pillar magnetic member. The refrigerator includes a first drawer located at a side of the first door; and a second drawer located at a side of the second door, where the first drawer and the second drawer have about a same width. The first drawer and the second drawer are configured to be flush with each other. The first drawer and the second drawer are configured to withdraw independently. The first door and the second door have about a same width. Each of the first door switch and the second door switch is configured to contact an end of the first door or the second door, the end being positioned opposite a rotation axis of a corresponding door. The pillar is configured to align with an edge to the second door based on the pillar being oriented in the folded orientation. The pillar is configured to be arranged parallel to a front surface of the second door based on the pillar being oriented in the unfolded orientation and the pillar is configured to be arranged perpendicular to the front surface of the second door based on the pillar being oriented in the folded orientation.

An innovative aspect of the subject matter described in this specification may be implemented in a refrigerator that includes a cabinet that includes a storage compartment; an inner case that defines the storage compartment; a first door that is pivotally mounted to the cabinet and that is configured to open or close a first side of the storage compartment; a second door that is pivotally mounted to the cabinet, that is configured to open or close a second side of the storage compartment, and that is provided with a pillar that is configured to rotate between a folded orientation and an unfolded orientation, the pillar being configured to contact the first door and thereby close a gap between the first door and the second door based on the pillar being oriented in the unfolded orientation and the first door and the second door being closed; a first door switch that is configured to sense at least one of opening or closing of the first door; a second door switch that is configured to sense at least one of opening or closing of the second door; a drive assembly that is located at the inner case and that is configured to rotate the pillar between the folded orientation and the unfolded orientation by magnetic force; and a controller that is configured to drive the drive assembly based on at least one of the first door switch or the second door switch sensing movement of at least one of the first door or the second door opening or closing, where the drive assembly is located at a top wall of the inner case, and where a portion of the top wall where the drive assembly is installed is flush with adjacent portions of the top wall.

An object of the subject matter described in this application is to provide a refrigerator having two side-by-side type doors to open one storage compartment, thereby being capable of achieving an improvement in use convenience.

DETAILED DESCRIPTION

Figure 1:
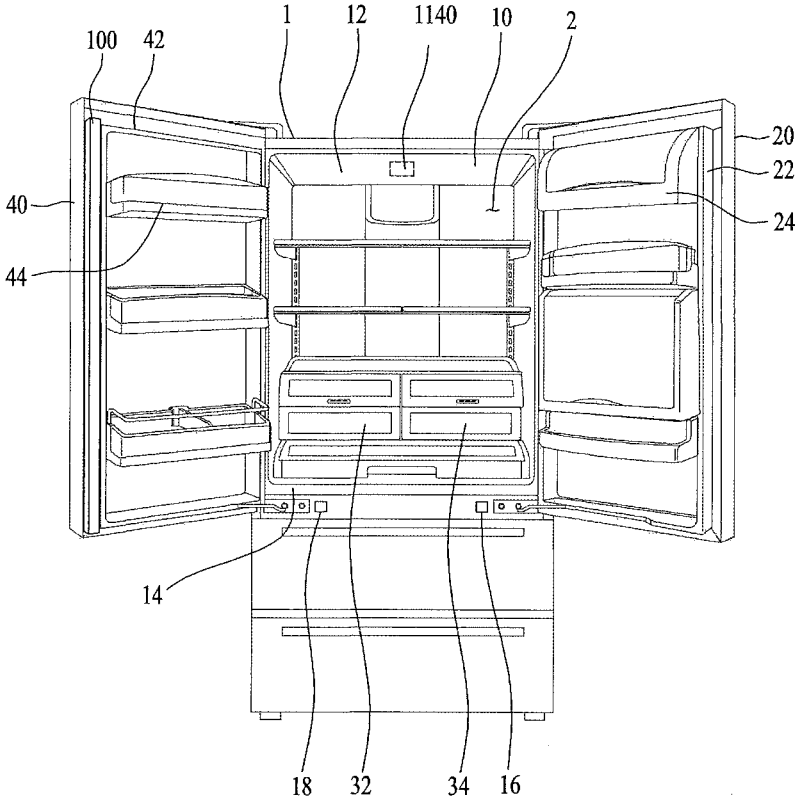
FIG. 1 is a front view of an example refrigerator.

FIG. 1 illustrates an example refrigerator.

Referring to FIG. 1, the refrigerator includes a cabinet 1 defining an appearance of the refrigerator.

The cabinet 1 is provided with a storage compartment 2 for storing food.

The storage compartment 2 may be defined by an inner case 10 provided at an inside of the cabinet 1. The inner case 10 may include a top wall 12 and a bottom wall 14 in order to define an inner surface of the storage compartment 2. The storage compartment 2 is open at a front side thereof and, as such, the user may access the storage compartment 2 through the front side of the storage compartment 2.

The cabinet 1 is provided, at a front side thereof, with a first door 20 pivotally mounted to the cabinet 1, to open or close one side of the storage compartment 2, and a second door 40 pivotally mounted to the cabinet 1, to open or close the other side of the storage compartment 2. When the first door 20 and second door 40 close the front side of the storage compartment 2, the storage compartment 2 may be completely sealed.

The second door 40 may be provided with a pillar 100 rotatable to come into contact with the first door 20. The pillar 100 generally has a rectangular parallelepiped shape. The pillar 100 is coupled to the second door 40 such that the pillar 100 is rotatable with respect to the second door 40.

The pillar 100 has a shorter length than the distance between the top wall 12 and the bottom wall 14 in the inner case 10 in order to prevent the pillar 100 from contacting the top wall 12 and bottom wall 14. That is, although the second door 40 rotates to close the storage compartment 2, the pillar 100 does not contact any of the top wall 12 and bottom wall 14. There is no element arranged at the structure of the inner case 10, namely, the top wall 12 and bottom wall 14, to limit rotation of the pillar 100 and, as such, the top wall 12 and bottom wall 14 may generally form one plane.

The first door 20 may be provided with a door dike 22 defining a rear appearance of the first door 20. Similarly, the second door 40 may be provided with a door dike 42 defining a rear appearance of the second door 40.

Baskets 24 and 44 may be mounted to the door dikes 22 and 42, to store various food articles. The basket 24, which is provided at the first door 20, at which the pillar 100 is not provided, does not interfere with the pillar 100 when the first door 20 rotates. In this regard, the basket 24 may have angled corners. In some implementations, it may be possible to store an increased amount of food in the basket 24, as compared to a basket having round corners.

The storage compartment 2 may be provided with a first drawer 34 arranged at the side of the first door 20, and a second drawer 32 arranged at the side of the second door 40. In some implementations, the first drawer 34 and second drawer 32 may be flush with each other. That is, the first drawer 34 and second drawer 32 may be arranged at approximately the same level at left and right sides in the storage compartment 2, respectively. The first drawer 34 and second drawer 32 may be independently withdrawn.

The first drawer 34 and second drawer 32 may have approximately the same width. That is, the first drawer 34 and second drawer 32 may have approximately the same storage capacity and, as such, are interchangeable. If the first drawer 34 and second drawer 32 have different widths and, as such, have different shapes, manufacturing costs thereof may be increased because it is necessary to manufacture two kinds of drawers. When the first drawer 34 and second drawer 32 have approximately the same shape, as described above, there is an advantage in that manufacturing costs may be reduced.

In some implementations, it may be possible to open the first door 20 and to withdraw the first drawer 34 under the condition that the second door 40 seals a corresponding portion of the storage compartment 2. This effect may be achieved because the pillar 100 is not arranged on a path, along which the first drawer 34 is withdrawn. This will be described later with reference to the accompanying drawings.

Meanwhile, in some implementations, the first door 20 and second door 40 may approximately have approximately the same width. Accordingly, the processes for manufacturing the first door 20 and second door 40 may be partially duplicated and, as such, manufacturing costs of the first door 20 and second door 40 may be reduced. This will be described later with reference to the remaining ones of the accompanying drawings.

A drive assembly 1140 may be provided at an inside of the top wall 12 in the inner case 10, to rotate the pillar 100 under particular conditions. The drive assembly 1140 is arranged to be movable in forward and rearward directions.

In some implementations, the pillar 100 may be rotated without using a physical element such as a guide protrusion, but using magnetic force. In this regard, the drive assembly 1140 may be embedded in the top wall 12, to be hidden from the user.

Accordingly, the portion of the top wall 12 where the drive assembly 1140 is installed may have the approximately same level as other portions of the top wall 12 adjacent thereto. That is, the portion of the top wall 12 where the drive assembly 1140 is installed is flush with the adjacent portions of the top wall 12 and, as such, the user cannot find whether or not the drive assembly 1140 is installed at the inside of the top wall 12. In this regard, it may be possible to eliminate inconvenience of the user caused by protrusion of the top wall portion where the drive assembly 1140 is installed or other problems, for example, reduction of storage capacity.

The cabinet 1 is provided with a first door switch 16 for sensing opening/closing of the first door 20 and a second door switch 18 for sensing opening/closing of the second door 40. In some implementations, it may be possible to determine whether each of the first and second doors 20 and 40 has been opened or closed in accordance with whether or not a corresponding one of the first and second door switches 16 and 18 has been pressed by the corresponding door.

For example, when the first door switch 16 has been pressed by the first door 20, it may be possible to determine that the first door 20 seals a corresponding portion of the storage compartment 2. When the second door switch 18 has been pressed by the second door 40, it may be possible to determine that the second door 40 seals a corresponding portion of the storage compartment 2.

Figure 2:
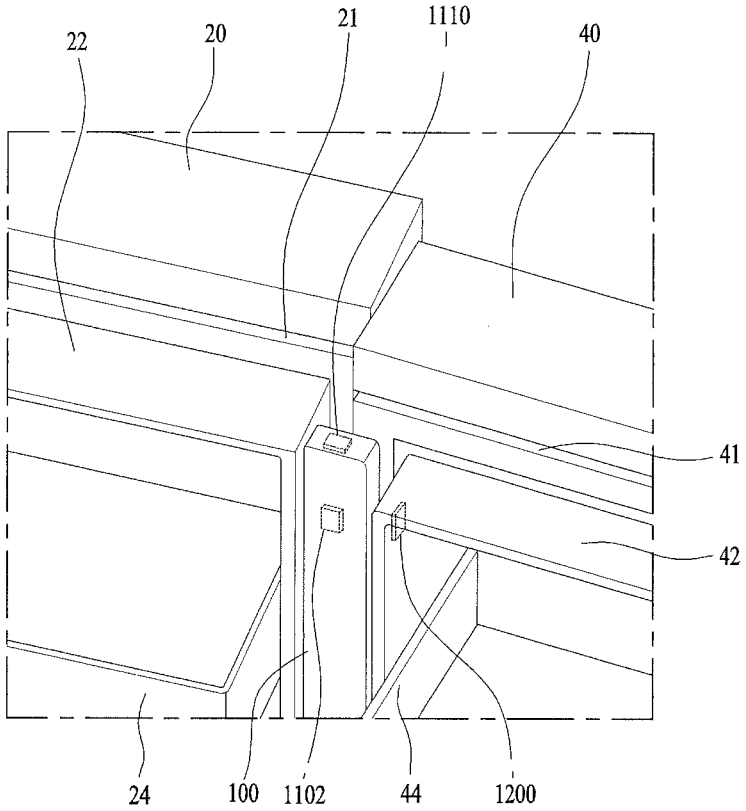
FIG. 2 is a view of an example region where magnetic members are installed.

FIG. 2 illustrates an example region where magnetic members are installed.

Referring to FIG. 2, gaskets 21 and 41 are installed at rear sides of the first and second doors 20 and 40, respectively. The gaskets 21 and 42 are made of a rubber material and, as such, may seal the storage compartment 2 while contacting an opening formed at the front side of the storage compartment 2.

The door dikes 22 and 42 may be arranged at rear sides of the gaskets 21 and 41, respectively, to define rear appearances of the first and second doors 20 and 40. As described above, the baskets 24 and 44 may be provided at the door dikes 22 and 42, respectively.

A door magnetic member 1200 may be provided at the second door 40. A second pillar magnetic member 1102, which magnetically interferes with the door magnetic member 1200, may be provided at the pillar 100. In some implementations, magnetic interference between the door magnetic member 1200 and the second pillar magnetic member 1102 may be generated due to attraction between the magnetic members 1200 and 1102.

Meanwhile, a first pillar magnetic member 1110 may be provided at an upper portion of the pillar 100. In some implementations, the first pillar magnetic member 1110 may be installed such that it is not exposed to the outside through an upper surface of the pillar 100, but is disposed at an uppermost portion of the pillar 100 in order to easily interfere with another magnet disposed thereabove.

In some implementations, each magnetic member may mean a magnet having north and south poles.

Each magnetic member may have a rectangular parallelepiped shape having a wider cross-section at one side than at the other side. That is, each magnetic member may be arranged such that one surface thereof facing another magnetic member is wider than the other surface thereof, in order to effectively generate interference between the facing magnetic members.

Figure 3:
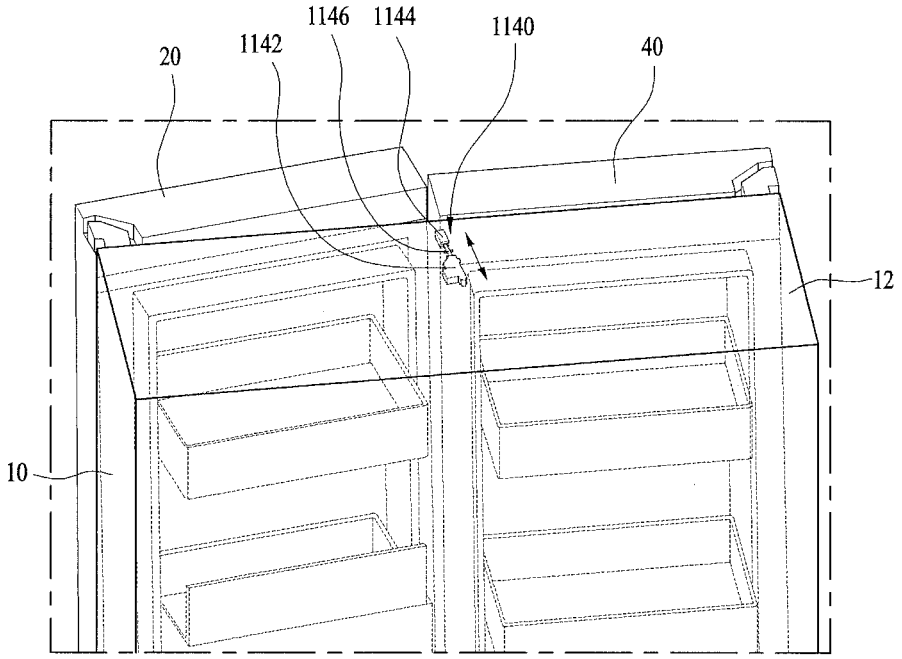
FIG. 3 is a view of an example region where magnetic members are installed.

FIG. 3 illustrates an example region different from FIG. 2 where magnetic members are installed.

Referring to FIG. 3, the drive assembly 1140 may be installed to be embedded within the top wall 12 of the inner case 10.

The drive assembly 1140, which is installed in the inner case 10, may rotate the pillar 100 by magnetic force.

The drive assembly 1140 may include a drive magnetic member 1144 movable in forward and rearward directions of the cabinet 1, a motor 1142 for generating rotational force, and a gear unit 1146 for moving the drive magnetic member 1144 in forward and rearward directions by the rotational force of the motor 1142.

The motor 1142 is a motor rotatable in normal and reverse directions. Upon receiving a predetermined signal, the motor 1142 rotates in a normal or reverse direction for a predetermined number of revolutions and, as such, moves the drive magnetic member 1144 in a forward or rearward direction.

The gear unit 1146 may convert rotation generated from the motor 1142 into linear motion. In addition, the gear unit 1146 may transfer rotational force to the drive magnetic member 1144 through a combination of gears of various types such as a rack and a pinion.

Upon receiving a predetermined signal from the outside, the drive assembly 1140 rotates the motor 1142 in a normal or reverse direction, thereby moving the drive magnetic member 1144 in a forward or rearward direction.

In accordance with movement or moved position of the drive magnetic member 1114, the pillar 100 may be rotated in a folding or unfolding direction.

Meanwhile, since the drive assembly 1140 is installed without being exposed to the outside of the top wall 12 or protruded from the top wall 12, the drive assembly 1140 does not physically limit rotation of the pillar 100. Accordingly, the portion of the top wall 12 in the inner case 10 where the drive assembly 1140 is installed may be flush with other portions of the top wall 12 adjacent thereto.

That is, rotation of the pillar 100 may be determined by magnetic interference between the drive assembly 1140 and the pillar 100.

Meanwhile, in order to prevent rotation of the pillar 100 from being physically limited under the condition that the second door 40 seals the storage compartment 2, the pillar 100 does not contact the top wall 12 of the inner case 10 and the bottom wall 14 of the inner case 10. To this end, the pillar 100 is spaced apart from the top wall 12 and bottom wall 14.

Figure 4:
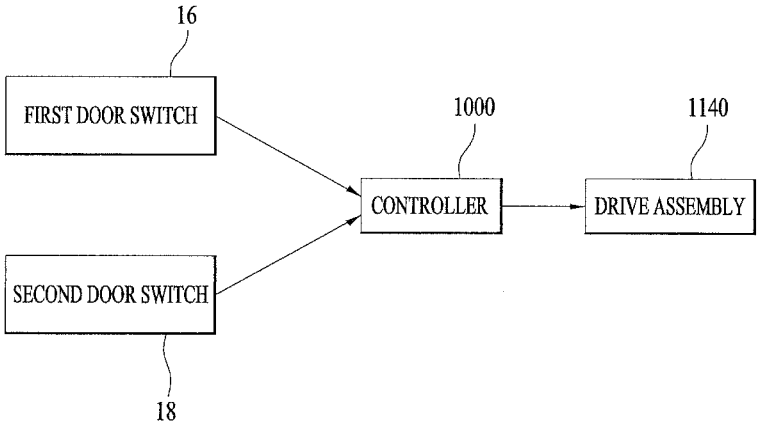
FIG. 4 is a block diagram of an example control configuration.

FIG. 4 illustrates a control configuration.

Referring to FIG. 4, the first door switch 16 may sense whether the first door 20 opens or closes the storage compartment 2, and may send a signal representing sensed results. The second door switch 18 may sense whether the second door 40 opens or closes the storage compartment 2, and may send a signal representing sensed results. That is, the first door switch 16 and second door switch 18 may independently sense whether corresponding ones of the doors 20 and 40 are opened or closed.

A controller 1000 is provided to send a predetermined signal to the drive assembly 1140 in accordance with a signal sent from the first door switch 16 or second door switch 18. In response to the signal, the drive assembly 1140 may rotate the motor 1142 in a normal or reverse direction.

In accordance with operation of the motor 1142 in the normal or reverse direction, the drive magnetic member 1144 may be moved in a forward or rearward direction with respect to the cabinet 1. Meanwhile, the motor 1142 may be stopped after rotating a predetermined number of revolutions. Since the motor 1142 rotates a predetermined number of revolutions, the drive magnetic member 1144 may be moved to a predetermined position.

When one of the first door switch 16 and second door switch 18 senses movement of the corresponding door to open or close the storage compartment 2, the controller 1000 may drive the drive assembly 1140.

Figure 5A:
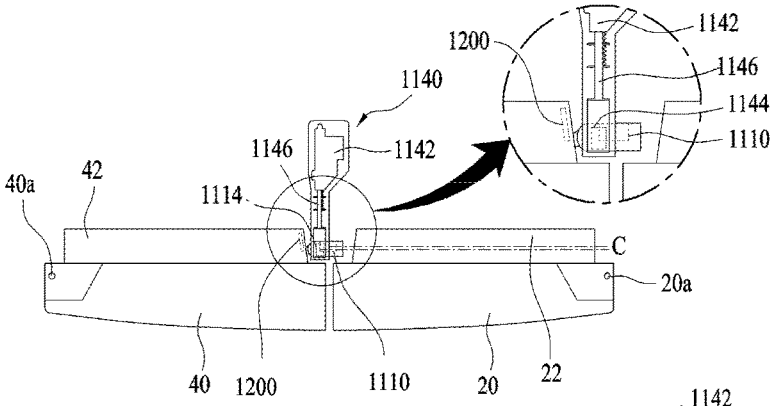
FIGS. 5(*a*)-5(*c*) illustrate an example operation in which a first door rotates to open a storage compartment that has been sealed by first and second doors.
Figure 5B:
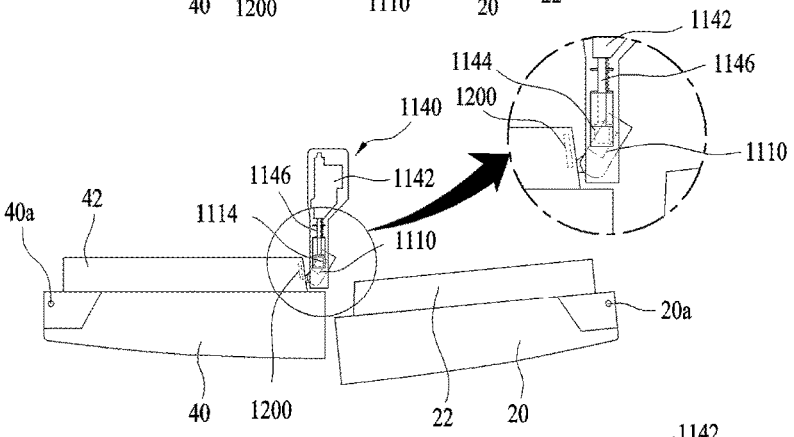
Figure 5C:
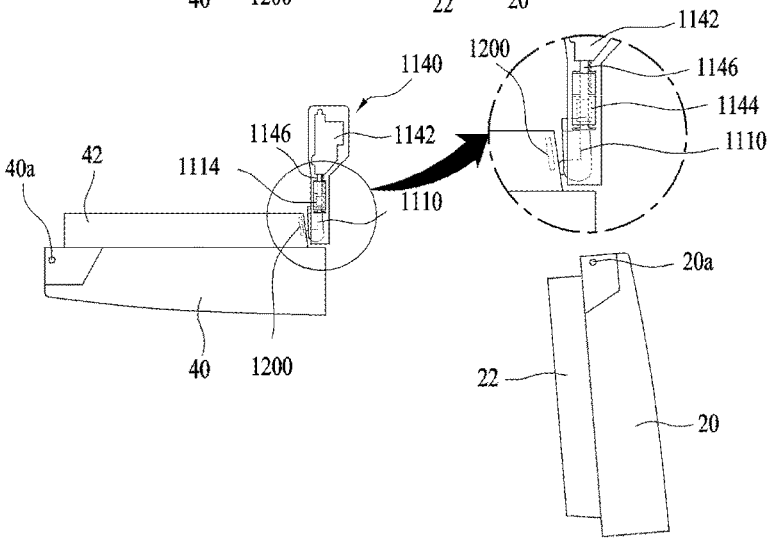

FIGS. 5(*a*)-5(*c*) illustrate an example operation in which the first door rotates to open the storage compartment that has been sealed by the first and second doors.

In a state of FIG. 5(*a*), the first door 20 and second door 40 seal the storage compartment 2. Through operations of FIGS. 5(*b*) and 5(*c*), the first door 20 may rotate under the condition that the second door 40 does not rotate. For reference, reference numeral "20*a*" designates a hinge axis of the first door 20, which is a rotation center of the first door 20, and reference numeral "40*a*" designates a hinge axis of the second door 20, which is a rotation center of the second door 40

As illustrated in FIG. 5(*a*), the user may open the storage compartment 2 by rotating the second door 40 under the condition that the first door 20 is in a closed state.

In some implementations, the second door switch 18 may sense opening of the second door 40.

A sensing signal generated by the second door switch 18 is sent to the controller 1000 which may, in turn, drive the motor 1142 of the drive assembly 1140. In some implementations, the motor 1142 rotates a rotation shaft thereof in a normal or reverse direction, thereby rotating the gear unit 1146. As a result, the drive magnetic member 1144 is moved in an upward direction, namely, toward the rear side of the cabinet 1, when viewed in FIG. 5.

That is, when the drive magnetic member 1144 moves rearwards, the pillar 100 is rotated in a counterclockwise direction and, as such, is folded toward the second door 40.

Then, rotation of the pillar 100 is continued by magnetic forces of the drive magnetic member 1144 and first pillar magnetic member 1110. In particular, the drive magnetic member 1144 and first pillar magnetic member 1110 may attract each other by the magnetic forces thereof.

In FIG. 5(*a*), the drive magnetic member 1144 is in a state of having been moved toward a foremost side of the cabinet 1. That is, the drive magnetic member 1144 is movable in forward and rearward directions, as illustrated in FIG. 5, and the forward/rearward movement trace thereof corresponds to the range illustrated in FIG. 5.

As illustrated in FIG. 5(*a*), in a state in which the drive magnetic member 1144 has moved toward the foremost side of the cabinet 1, the center of the drive magnetic member 1144 in forward and rearward directions may be positioned forwards of the center of the first pillar magnetic member 1110 in forward and rearward directions. That is, a gap may be formed between the center of the drive magnetic member 1144 in forward and rearward directions and the center of the first pillar magnetic member 1110 in forward and rearward directions.

Since the center of the drive magnetic member 1144 is positioned forwards of the center of the first pillar magnetic member 1110, the pillar 100 may exhibit increased contact force with respect to the first door 20 and second door 40. When the pillar 100 is in an unfolded state with respect to the second door 40, the pillar 100 should closely contact the first door 20 and second door 40 in order to prevent cold air from leaking through the first door 20 and second door 40.

In particular, when attraction is generated between the drive magnetic member 1144 and the first pillar magnetic member 1110, the pillar 100 acts to be further unfolded in the state of FIG. 5(*a*) because the drive magnetic member 1144 continuously attracts the first pillar magnetic member 1110. In this state, accordingly, the pillar 100 may closely contact the gaskets of the doors 20 and 40.

The drive magnetic member 1144 carries out straight motion in forward and rearward directions, whereas the pillar 100 carries out rotational motion about a portion thereof close to the second door 40. Accordingly, it may be possible to easily rotate the pillar 100 by magnetic forces of the first pillar magnetic member 1110 and drive magnetic member 1144 when relatively great rotational force is applied to the pillar 100. The magnitudes of magnetic forces of the first pillar magnetic member 1110 and drive magnetic member 1144 are taken into consideration as an important factor. In some implementations, a portion of the pillar 100 corresponding to an arm, to which rotational force to rotate the pillar 100 is applied, is also taken into consideration as an important factor. In this regard, the drive magnetic member 1144 is arranged to be spaced apart from a rotation axis of the pillar 100 by a predetermined distance.

Meanwhile, when a portion of the opening of the storage compartment 2 is completely opened in accordance with complete rotation of the first door 20, as illustrated in FIG. 5(*c*), the pillar 100 may be maintained in a folded state with respect to the second door 40 due to attraction acting between the door magnetic member 1200 and the second pillar magnetic member 1102.

In the folded state of the pillar 100, the second pillar magnetic member 1102 and door magnetic member 1200 continuously attract each other. Accordingly, the folded state of the pillar 100 may be maintained in spite of magnetic interference between the drive magnetic member 1144 and the first pillar magnetic member 1110.

Meanwhile, in the state of FIG. 5(*c*), although the second door 40 seals the corresponding portion of the storage compartment 2, the basket of the first door 20 is not caught on the pillar 100 because the pillar 100 is in a folded state. Accordingly, the basket of the first door 20 may have angled corners and, as such, may provide an increased storage space, as compared to the case in which the pillar 100 cannot be folded.

In addition, in the state of FIG. 5(*c*), the drawer arranged at the side of the first door 20 is not caught on the pillar 100 during withdrawal thereof. Since the pillar 100 is folded toward the second door 40, there is no portion of the storage compartment 2 covered by the pillar 100.

Accordingly, it may be possible to increase the width of the drawer arranged at the side of the first door 20. Consequently, the drawer arranged at the side of the first door 20 and the drawer arranged at the side of the second door 40 may have approximately the same width.

Figure 6A:
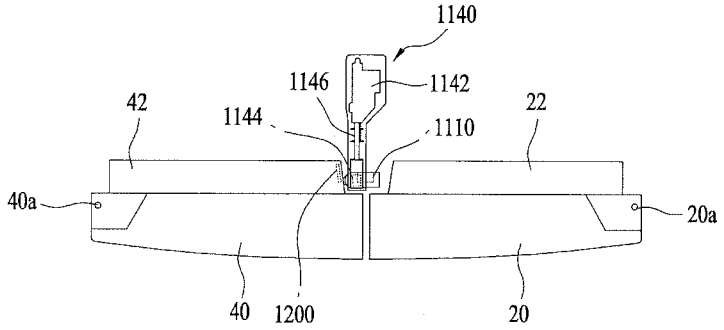
FIGS. 6(*a*)-6(*c*) illustrate an example operation in which a second door rotates to open a storage compartment that has been sealed by first and second doors.
Figure 6B:
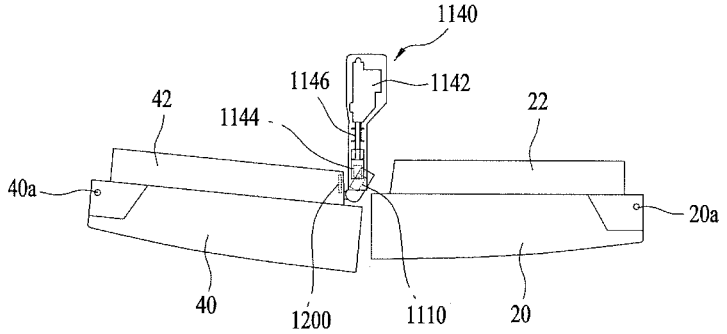
Figure 6C:
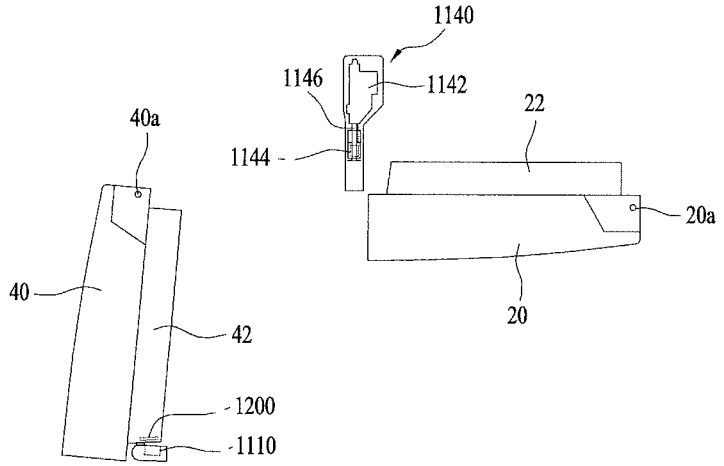

FIGS. 6(*a*)-6(*c*) illustrate an example operation in which the second door rotates to open the storage compartment that has been sealed by the first and second doors.

As illustrated in FIG. 6(*a*), the pillar 100 is in an unfolded state when the first door 20 and second door 40 seal the storage compartment 2. When the first door switch 16 senses opening of the storage compartment 2 caused by rotation of the first door 20, as illustrated in FIG. 6(*b*), the motor 1142 is rotated to move the drive magnetic member 1144 in a rearward direction.

Then, the pillar 100 is folded toward the second door 40 due to magnetic interference between the drive magnetic member 1144 and the first pillar magnetic member 1110.

When the user opens the second door 40 under the condition that the first door 20 is in a closed state, the pillar 100 may be caught on the first door 20. In some implementations, as the pillar 100 is maintained in a state of being folded toward the second door 40 during opening of the second door 40, there is no interference between the pillar 100 and the first door 20.

That is, when any one of the first door switch 16 and second door switch 18 senses opening of the corresponding door, the controller 1000 moves the drive magnetic member 1114 toward the rear side of the cabinet 1. In a state in which any one of the doors is opened, the pillar 100 is in a state of being folded toward the second door 40.

Figure 7A:
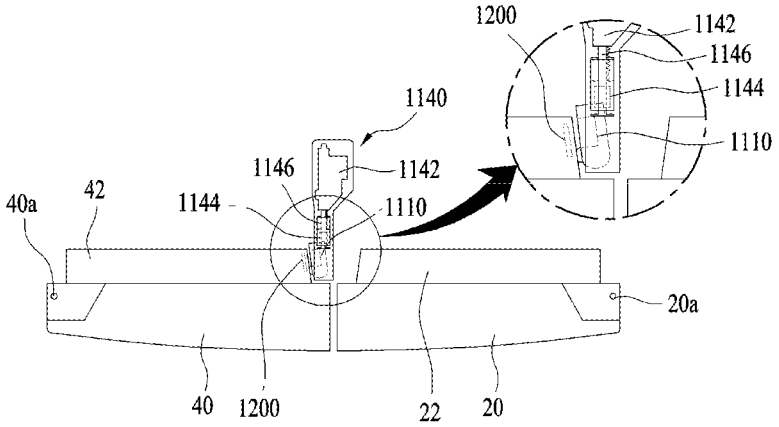
FIGS. 7(*a*)-7(*c*) illustrate an example operation in which a pillar rotates after rotation of an opened first or second door, to seal the storage compartment.
Figure 7B:
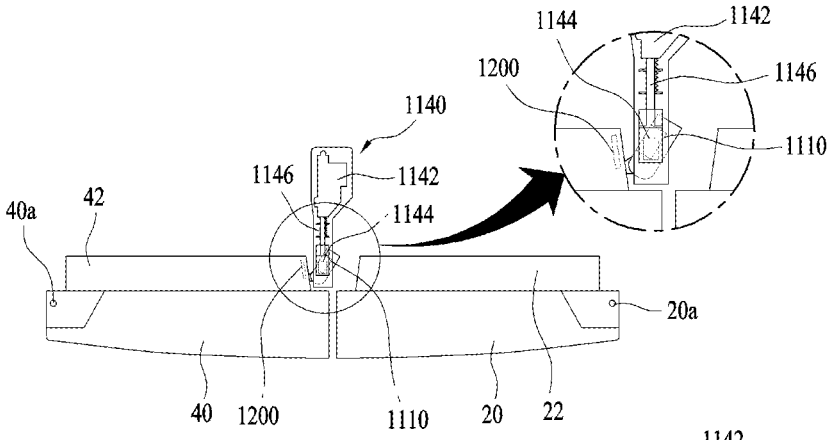
Figure 7C:
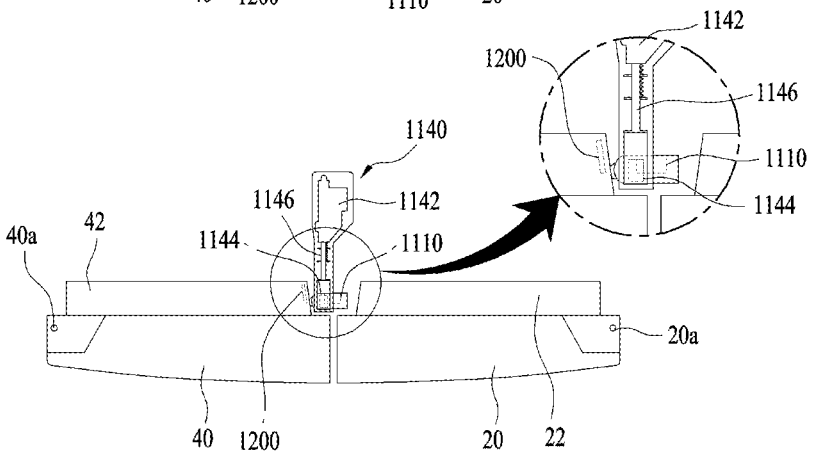

FIGS. 7(*a*)-7(*c*) illustrate an example operation in which the pillar rotates after rotation of an opened one of the first and second doors, to seal the storage compartment.

In a state in which the first door 20 opens the corresponding portion of the storage compartment 2 under the condition that the second door 40 seals the corresponding portion of the storage compartment 2, the user may rotate the first door 20, to seal the storage compartment 2.

In addition, in a state in which the second door 40 opens the corresponding portion of the storage compartment 2 under the condition that the first door 20 seals the corresponding portion of the storage compartment 2, the user may rotate the second door 40, to seal the storage compartment 2.

In either case, the user rotates the opened door under the condition that the sealing door is maintained in a closed state without being rotated. When the opened one of the first door 20 and second door 40 is rotated such that the storage compartment 2 is sealed by both the first door 20 and the second door 40, the controller 1000 may receive a signal representing door closing from each of the first door switch 16 and second door switch 18.

When the controller 1000 determines that both the first door 20 and the second door 40 have been closed, the controller 1000 drives the motor 1142, to move the drive magnetic member 1144 in a forward direction. In some implementations, the motor 1142 rotates in a normal or reverse direction, differently than the above-described case, and, as such, may straightly move the drive magnetic member 1144.

That is, the drive magnetic member 1144 begins to operate in a state in which both the first door 20 and the second door 40 have been closed.

When a signal representing closing of each of the first door 20 and second door 40 is generated, the motor 1142 is driven, as illustrated in FIG. 7(*a*), and, as such, the pillar 100 may be rotated in the order of FIGS. 7(*b*) and 7(*c*).

When the drive magnetic member 1144 moves to the front side of the cabinet 1, the pillar 100 is rotated in a clockwise direction and, as such, is unfolded with respect to the second door 40. That is, the pillar 100 comes into contact the gaskets of the first door 20 and second door 40 and, as such, the storage compartment 2 may be sealed.

Thus, the pillar 100 may closely contact the gaskets of the doors 20 and 40 by magnetic interference between the first pillar magnetic member 110 and the drive magnetic member 1144 and, as such, sufficient sealing force may be secured.

In some implementations, the pillar 100 may be guided toward the first door 20 and second door 40 because the center of the drive magnetic member 1144 in forward and rearward directions is arranged forwards of the center of the first pillar magnetic member 1110 in forward and rearward directions. Accordingly, the storage compartment 2 may be maintained in a sealed state by the pillar 100, first door 20, and second door 40.

Figure 8A:
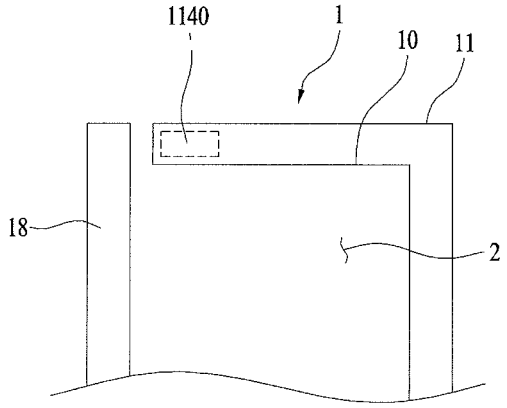
FIGS. 8(*a*) and 8(*b*) are schematics of an example refrigerator.
Figure 8B:
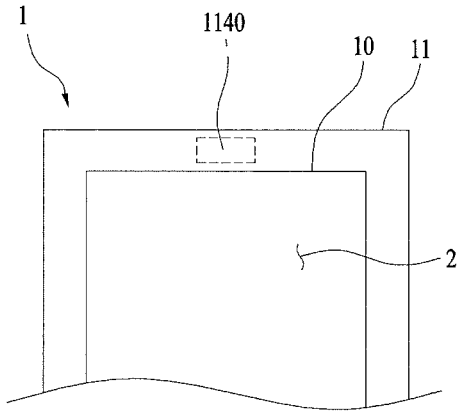

FIGS. 8(*a*) and 8(*b*) illustrate schematics of an example refrigerator.

FIG. 8(*a*) is a side view of the refrigerator. FIG. 8(*b*) is a front view of the refrigerator in a state in which the doors of the refrigerator are removed.

Referring to FIGS. 8(*a*) and 8(*b*), the drive assembly 1140 is embedded between an outer case 11 defining an appearance of the cabinet 1 and the inner case 10 defining the storage compartment 2.

Since the drive assembly 1140 is not protruded in an outward direction from the inner case 10, the user cannot find the drive assembly 1140 with the naked eye.

In addition, since the drive assembly 1140 is installed to be flush with portions of the inner case 10 adjacent thereto, it may be difficult to find the position, at which the drive assembly 1140 is installed. Accordingly, the user does not feel inconvenience in using the storage compartment 2 due to installation of the drive assembly 1140.

Figure 9A:
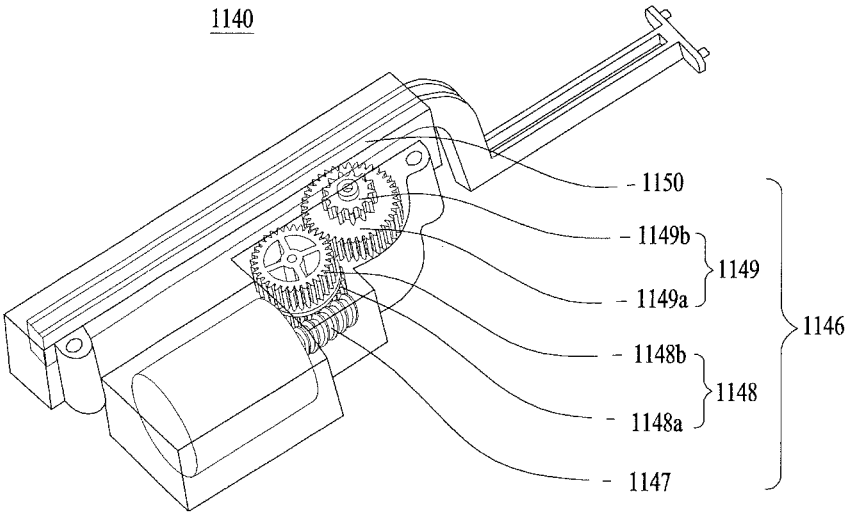
FIGS. 9(*a*) and 9(*b*) are a views of an example drive assembly.
Figure 9B:
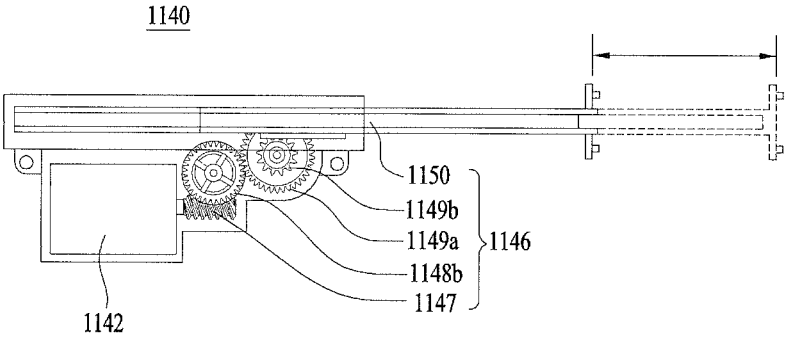

FIGS. 9(*a*) and 9(*b*) illustrate an example drive assembly.

FIG. 9(*a*) is a perspective view illustrating a configuration of the drive assembly 1140. FIG. 9(*b*) is a top view illustrating the configuration of the drive assembly 1140.

The motor 1142 of the drive assembly 1140 may be driven at a voltage of 24 volts.

In addition, the motor 1142 exhibits output torque of 3 kgf (kilogram-force). In addition, the operation time of the motor 1142 rotating in a normal or reverse direction is about 0.3 seconds. In some implementations, the pillar 100 may complete rotation of a desired angle for the operation time of the motor 1142, namely, 0.3 seconds. Typically, the user may operate the doors without interfering with the pillar 100 when the pillar 100 is rotated to a predetermined position within 0.3 seconds.

Referring to FIG. 9, rotation of the motor 1142 is converted into linear motion by the gear unit 1146.

Hereinafter, the gear unit 1146 will be described in detail. A worm gear 1147 is mounted to the rotation shaft of the motor 1142. In accordance with use of the worm gear 1147, the rotation shaft of the motor 1142 may be arranged in parallel to the forward or rearward direction of the magnetic driving unit. Typically, the motor 1142 inevitably has a longer height from the rotation shaft thereof to a body thereof than the width thereof or the length thereof in forward and rearward directions.

When the motor 1142 is vertically arranged between the inner case and the outer case, thermal insulation performance may be degraded because the thickness of an insulator filled between the inner case and the outer case is reduced. In some implementations, there is an advantage in that reduction in thickness of the insulator may be prevented in accordance with use of the worm gear 1147.

The worm gear 1147 is engaged with a first gear unit 1148. The first gear unit 1148 may include a worm wheel gear 1148*a* engaged with the worm gear 1147, to rotate together with the worm gear 1147, and a first driven gear 1148*b* to rotate integrally with the worm wheel gear 1148*a*.

The worm wheel gear 1148*a* and first driven gear 1148*b* may be arranged at different levels.

The worm wheel gear 1148*a* is formed with teeth to be engaged with the worm gear 1147 and, as such, may change direction of rotational force supplied from the motor 1142.

The first driven gear 1148*b* is engaged with a second gear 1149. The second gear unit 1149 may include a gear 1149*a* engaged with the first driven gear 1148*b*, to rotate together with the first driven gear 1148*b*, and a second driven gear 1149*b* to rotate integrally with the gear 1149*a*.

In some implementations, the second driven gear 1149*b* may be a pinion gear.

The second gear unit 1149 may receive rotational force transferred from the first gear unit 1148. The first driven gear 1148*b* is formed with teeth to be engaged with the gear 1149*a* and, as such, rotation force of the first gear 1148 may be transferred to the second gear unit 1149.

In some implementations, the first driven gear 1148*b* has a smaller radius than the gear 1149*a*. Accordingly, when the first driven gear 1148*b* and gear 1149*a* rotate in an engaged state, the angular velocity of the gear 1149*a* may be lower than that of the first driven gear 1148*b*. As a result, when rotation force is transferred from the first gear unit 1148 to the second gear unit 1149, an increase in torque may occur.

Meanwhile, in the second gear unit 1149, the gear 1149*a* has a larger radius than the pinion gear 1149*b*. Accordingly, torque transferred to the pinion gear 1149*b* may increase.

In some implementations, a rack gear 1150 is engaged with the pinion gear 1149*b* and, as such, rotational force of the motor 1142 may be converted into straight motion.

When the motor 1142 rotates in a normal or reverse direction, the pinion gear 1149*b* may be rotated in a clockwise or counterclockwise direction. In some implementations, the rack gear 1150, which is engaged with the pinion gear 1149*b*, may also be moved in a forward or rearward direction.

That is, rotation of the motor 1142 is finally transferred to the gear unit 1146. In some implementations, the gear unit 1146 may move in a forward or rearward direction within a stroke of about 50 mm The drive magnetic member is moved in a forward or rearward direction by the stroke of the above-described range and, as such, the pillar may be rotated.

Figure 10:
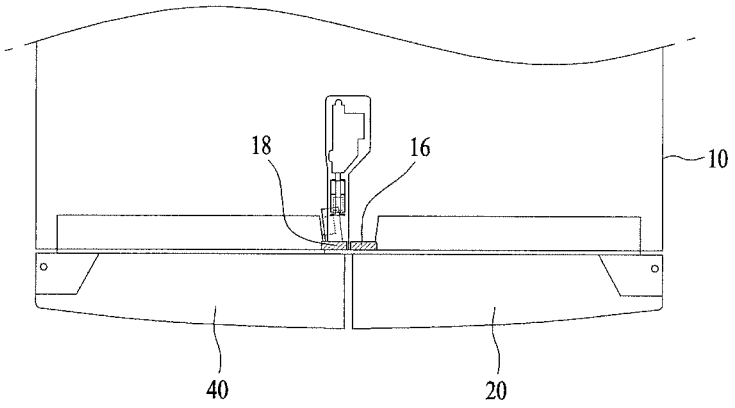
FIG. 10 is a view of example positions of door switches.

FIG. 10 illustrates example positions of the door switches.

Referring to FIG. 10, the door switches 16 and 18 may be installed to be close to the center of the inner case 10. The door switches 16 and 18 may be arranged at positions opposite to the rotation axes of the doors 20 and 40, respectively.

It is possible to more rapidly sense whether or not the doors 20 and 40 have been rotated, at positions opposite to the rotation axes of the doors 20 and 40 than at positions corresponding to the rotation axes of the doors 20 and 40. This is because, although each of the doors 20 and 40 rotates through approximately same angle at all positions thereof, the rotation distance of the door 20 or 40 is increased at a position of the door 20 or 40 spaced farther from the rotation axes of the door 20 or 40 than other positions of the door 20 or 40.

In the case in which whether the doors 20 and 40 have been opened or closed is sensed in accordance with whether the door switches 16 and 18 have been pressed by the doors 220 and 40, the door switches 16 and 18 may be installed at positions far from the rotation axes of the doors 20 and 40, respectively. In some implementations, even when the doors 20 and 40 rotate through a small angle, the door switches 16 and 18 may be easily changed between a pressed state and a released state.

The door switches 16 and 18 may rapidly sense opening/closing of the corresponding doors, to enable the motor 1142 to drive rapidly. In some implementations, the pillar is appropriately rotated when the user opens or closes the doors and, as such, the pillar does not interfere with operation of the user to open or close the doors. In addition, when the user closes the doors, the storage compartment 2 may be rapidly sealed by the pillar and doors.

That is, the door switches 16 and 18 are arranged at ends of the doors 20 and 40 opposite to rotation axes of the doors 20 and 40, respectively, in order to operate the motor 1142 simultaneously with opening of each door 20 or 40 and, as such, operation of the motor 1142 may be rapidly carried out.

Meanwhile, the door switches 16 and 18 may be installed to come into contact with the doors 20 and 40, respectively, and, as such, do not interfere with the drive assembly 1140.

As apparent from the above description, the structure for rotating the pillar does not protrude into the storage compartment and, as such, the capacity of the storage compartment may be increased. In addition, inconvenience of the user caused by a protruding structure may be eliminated.

In addition, the pillar is in a folded state under the condition that the door provided with the pillar seals the storage compartment, and the other door opens the storage compartment. Accordingly, when the drawer installed at the side of the other door is withdrawn, the drawer is not caught on the pillar. In this regard, it may be possible to install a pair of drawers having approximately the same width at respective sides of the doors.

Meanwhile, since the pillar is in a folded state under the condition that the door provided with the pillar seals the storage compartment, and the other door opens the storage compartment, the basket installed at the other door is not caught on the pillar when the other door rotates. Accordingly, the basket may have angled corners and, as such, may have an increased storage capacity.

What is claimed is:

1. A refrigerator comprising:

a cabinet that includes a storage compartment;

an inner case that defines the storage compartment;

a first door that is pivotally mounted to the cabinet and that is configured to open or close a first side of the storage compartment;

a second door that is pivotally mounted to the cabinet, that is configured to open or close a second side of the storage compartment, and that is provided with a pillar that is configured to rotate between a folded orientation and an unfolded orientation, the pillar being configured to contact the first door and thereby close a gap between the first door and the second door based on the pillar being oriented in the unfolded orientation and the first door and the second door being closed;

a first door switch that is configured to sense at least one of opening or closing of the first door;

a second door switch that is configured to sense at least one of opening or closing of the second door;

a drive assembly that is located at the inner case and that is configured to rotate the pillar between the folded orientation and the unfolded orientation by magnetic force; and a controller that is configured to drive the drive assembly based on at least one of the first door switch or the second door switch sensing movement of at least one of the first door or the second door opening or closing.

2. The refrigerator according to claim 1, wherein the controller is configured to drive the drive assembly to rotate the pillar to the folded orientation based on the first door switch sensing that the first door is open and the second door switch sensing that the second door is closed.

3. The refrigerator according to claim 1, wherein the controller is configured to drive the drive assembly to rotate the pillar to the unfolded orientation based on at least one of the first door switch sensing that first door is closed or the second door switch sensing that the second door is closed.

4. The refrigerator according to claim 1, wherein the controller is configured to drive the drive assembly to rotate the pillar to the folded orientation based on at least one of the first door switch sensing that the first door is opening or the second door switch sensing that the second door is opening while the first door and the second door are closed.

5. The refrigerator according to claim 1, wherein:

the drive assembly comprises a drive magnetic member that is configured to move in a forward direction and a rearward direction relative to the cabinet, and the pillar comprises a first pillar magnetic member that is configured to magnetically interfere with the drive magnetic member.

6. The refrigerator according to claim 5, wherein:

the pillar is configured to rotate toward the second door to the folded orientation based on the drive magnetic member moving toward a rear side of the cabinet, and the pillar is configured to rotate toward the second door to the unfolded orientation based on the drive magnetic member moving toward a front side of the cabinet.

7. The refrigerator according to claim 5, wherein the drive assembly further comprises:

a motor that is configured to generate a rotational force in a normal direction or a reverse direction; and a gear unit that is configured to move the drive magnetic member in the forward direction or the rearward direction by the rotational force of the motor.

8. The refrigerator according to claim 5, wherein the drive magnetic member has a center that is positioned in front of a center of the first pillar magnetic member based on the drive magnetic member being moved toward a foremost side of the cabinet.

9. The refrigerator according to claim 5, wherein:

the drive magnetic member is configured to rotate the pillar to the unfolded orientation by extending away from the drive assembly, and the drive magnetic member is configured to rotate the pillar to the folded orientation by retracting towards the drive assembly.

10. The refrigerator according to claim 5, wherein the gear unit comprises:

a first gear that is configured to change a rotation direction of the motor;

a second gear that is configured to engage the first gear and that is configured to rotate together with the first gear; and a rack gear that is configured to engage the second gear and that is configured to convert rotation of the second gear into a linear motion.

11. The refrigerator according to claim 10, wherein the motor comprises a rotation shaft that is substantially parallel to the forward direction and the rearward direction.

12. The refrigerator according to claim 1, wherein:

the second door includes a door magnetic member, and the pillar includes a second pillar magnetic member that is configured to magnetically interfere with the door magnetic member.

13. The refrigerator according to claim 12, wherein, based on the pillar being rotated toward the second door to the folded orientation, the pillar is configured to remain in the folded orientation by an attraction between the door magnetic member and the second pillar magnetic member.

14. The refrigerator according to claim 1, further comprising:

a first drawer located at a side of the first door; and a second drawer located at a side of the second door, wherein the first drawer and the second drawer have about a same width.

15. The refrigerator according to claim 14, wherein:

the first drawer and the second drawer are configured to be flush with each other; and the first drawer and the second drawer are configured to withdraw independently.

16. The refrigerator according to claim 1, wherein the first door and the second door have about a same width.

17. The refrigerator according to claim 1, wherein each of the first door switch and the second door switch is configured to contact an end of the first door or the second door, the end being positioned opposite a rotation axis of a corresponding door.

18. The refrigerator according to claim 1, wherein the pillar is configured to align with an edge to the second door based on the pillar being oriented in the folded orientation.

19. The refrigerator according to claim 1, wherein the pillar is configured to be arranged parallel to a front surface of the second door based on the pillar being oriented in the unfolded orientation and the pillar is configured to be arranged perpendicular to the front surface of the second door based on the pillar being oriented in the folded orientation.

20. A refrigerator comprising:

a cabinet that includes a storage compartment;

an inner case that defines the storage compartment;

a first door that is pivotally mounted to the cabinet and that is configured to open or close a first side of the storage compartment;

a second door that is pivotally mounted to the cabinet, that is configured to open or close a second side of the storage compartment, and that is provided with a pillar that is configured to rotate between a folded orientation and an unfolded orientation, the pillar being configured to contact the first door and thereby close a gap between the first door and the second door based on the pillar being oriented in the unfolded orientation and the first door and the second door being closed;

a first door switch that is configured to sense at least one of opening or closing of the first door;

a second door switch that is configured to sense at least one of opening or closing of the second door;

a drive assembly that is located at the inner case and that is configured to rotate the pillar between the folded orientation and the unfolded orientation by magnetic force; and a controller that is configured to drive the drive assembly based on at least one of the first door switch or the second door switch sensing movement of at least one of the first door or the second door opening or closing, wherein the drive assembly is located at a top wall of the inner case, and wherein a portion of the top wall where the drive assembly is installed is flush with adjacent portions of the top wall.

* * * * *